US006499156B1

(12) United States Patent
Dirst

(10) Patent No.: US 6,499,156 B1
(45) Date of Patent: Dec. 31, 2002

(54) EXAMINATION TABLE SYSTEM

(76) Inventor: Tracy L. Dirst, 33413 E. County Rd. 2400 N., Manito, IL (US) 61546

( * ) Notice: Subject to any disclaimer, the term of this patent is extended or adjusted under 35 U.S.C. 154(b) by 16 days.

(21) Appl. No.: 09/797,610

(22) Filed: Mar. 5, 2001

(51) Int. Cl.[7] ..... A61G 13/02; A47B 9/18
(52) U.S. Cl. ..... 5/81.1 C; 5/600; 5/611
(58) Field of Search ..... 5/600, 488, 692, 5/81.1 C, 81.11 HS, 88.1, 11, 611, 624, 649, 602

(56) References Cited

U.S. PATENT DOCUMENTS

| | | | | | |
|---|---|---|---|---|---|
| 545,741 | A | * | 9/1895 | Shutters | 5/88.1 |
| 1,318,271 | A | * | 10/1919 | Ford | 5/600 |
| 1,793,006 | A | * | 2/1931 | O'Neill | 5/600 |
| 1,877,610 | A | * | 9/1932 | Steiner | 108/90 |
| 2,120,732 | A | * | 6/1938 | Comper et al. | 5/602 |
| 2,257,491 | A | * | 9/1941 | Armstrong | 5/602 |
| 2,306,031 | A | * | 12/1942 | Anderson et al. | 5/602 |
| 2,540,133 | A | * | 2/1951 | Miller | 5/614 |
| 2,592,166 | A | * | 4/1952 | McLean et al. | 5/611 |
| 2,604,639 | A | * | 7/1952 | Killifer | 5/611 |
| 2,605,151 | A | * | 7/1952 | Shampaine | 5/602 |
| 2,679,445 | A | * | 5/1954 | Roehm | 312/209 |
| 2,681,454 | A | * | 6/1954 | Tallman | 5/11 X |
| 2,827,641 | A | * | 3/1958 | Reichert et al. | 5/611 |
| 2,832,655 | A | * | 4/1958 | Adolphson | 5/602 |
| 2,872,688 | A | * | 2/1959 | Reichert et al. | 5/611 |
| 3,012,253 | A | * | 12/1961 | Reichert | 5/611 X |
| 3,039,118 | A | * | 6/1962 | Hutt | 5/611 |
| 3,105,246 | A | * | 10/1963 | Emrick | 5/611 X |
| 3,343,183 | A | * | 9/1967 | Sannes | 5/488 |
| 3,466,679 | A | * | 9/1969 | Hess | 5/488 |
| 3,587,482 | A | * | 6/1971 | Wieland | 5/611 X |
| 3,593,351 | A | * | 7/1971 | Dove | 5/88.1 |
| 3,612,509 | A | * | 10/1971 | Boston | 269/98 |
| 3,628,199 | A | * | 12/1971 | Helton | 5/611 |
| 3,641,600 | A | * | 2/1972 | Oats | 5/488 |
| 3,794,313 | A | * | 2/1974 | Berger et al. | 5/488 X |
| 3,810,263 | A | * | 5/1974 | Taylor et al. | 5/81.1 C |
| 3,814,414 | A | * | 6/1974 | Chapa | 5/611 X |
| 3,820,176 | A | * | 6/1974 | Feiertag | 5/611 |
| 3,924,281 | A | * | 12/1975 | Gibbs | 5/88.1 |
| 3,944,205 | A | * | 3/1976 | Mueller | 5/624 |
| 3,946,450 | A | * | 3/1976 | Staggs | 5/488 |
| 3,974,388 | A | * | 8/1976 | Distler et al. | 378/20 |
| 4,003,704 | A | * | 1/1977 | Zurolo et al. | 250/455.11 |

(List continued on next page.)

FOREIGN PATENT DOCUMENTS

| | | | | | |
|---|---|---|---|---|---|
| AU | 245269 | A | * | 5/1963 | 5/611 |
| DE | 2623933 | A1 | * | 1/1977 | 5/88.1 |
| DE | 2720734 | A1 | * | 9/1978 | 5/488 |
| DE | 3438956 | A | * | 5/1985 | 5/88.1 |
| DE | 3443334 | A | * | 6/1986 | 5/611 |
| FR | 1400068 | | * | 4/1965 | 5/88.1 |
| GB | 855930 | A | * | 12/1960 | 5/611 |
| GB | 2130482 | A | * | 6/1984 | 5/88.1 |
| WO | WO 86/00221 | | * | 1/1986 | 5/88.1 |

*Primary Examiner*—Robert G. Santos

(57) ABSTRACT

An examination table system for facilitating movement of a patient lying on a tabletop of the table system. The examination table system includes a table assembly for supporting the patient above a floor surface. The table assembly includes a generally planar tabletop and a plurality of leg members. A conveyor system is provided for moving the patient lying on the tabletop in a direction parallel to the tabletop. The conveyor system comprises a conveyor belt mounted about the table for movement. A pair of end rollers mounted to one of a pair of ends of the tabletop is provided for moving the conveyor belt about a pair of opposite ends of the tabletop. A drive assembly is provided for moving the conveyor belt about the tabletop. The drive assembly comprises a conveyor belt motor mounted to the table and a control for controlling operation of the conveyor belt motor.

16 Claims, 3 Drawing Sheets

U.S. PATENT DOCUMENTS

| | | | | | |
|---|---|---|---|---|---|
| D245,287 | S | | 8/1977 | Damico et al. | |
| 4,042,985 | A | * | 8/1977 | Raczkowski | 5/488 |
| 4,131,802 | A | | 12/1978 | Braden et al. | |
| 4,175,783 | A | * | 11/1979 | Pioth | 296/20 |
| 4,270,233 | A | * | 6/1981 | Mulligan | 5/602 |
| 4,270,234 | A | * | 6/1981 | James | 5/88.1 |
| 4,489,449 | A | * | 12/1984 | Failor et al. | 5/83.1 |
| 4,669,136 | A | * | 6/1987 | Waters et al. | 5/611 X |
| 4,723,808 | A | * | 2/1988 | Hines | 5/611 X |
| 4,773,637 | A | | 9/1988 | Jarin | |
| 4,823,774 | A | * | 4/1989 | Grasser | 601/4 |
| 4,843,665 | A | * | 7/1989 | Cockel et al. | 5/88.1 |
| 4,926,513 | A | * | 5/1990 | Oats | 5/488 |
| 4,945,585 | A | * | 8/1990 | Stewart | 5/122 |
| 5,054,140 | A | * | 10/1991 | Bingham et al. | 5/600 |
| 5,095,560 | A | * | 3/1992 | Volker | 5/611 X |
| 5,134,731 | A | * | 8/1992 | Quintile et al. | 5/611 X |
| 5,272,776 | A | | 12/1993 | Kitamura | |
| 5,390,379 | A | * | 2/1995 | Palmer, Jr. et al. | 5/81.1 C |
| 5,507,050 | A | | 4/1996 | Welner | |
| 5,590,429 | A | | 1/1997 | Boomgaarden et al. | |
| 5,659,905 | A | * | 8/1997 | Palmer, Jr. et al. | 5/88.1 |
| 5,808,468 | A | | 9/1998 | Bis et al. | |
| 5,913,773 | A | * | 6/1999 | Cox | 5/600 |
| 6,006,378 | A | * | 12/1999 | Hayashi | 5/488 |
| 6,363,555 | B1 | * | 4/2002 | LaRose | 5/600 |
| 2002/0023297 | A1 | * | 2/2002 | Khait | 5/600 |

* cited by examiner

EXAMINATION TABLE SYSTEM

BACKGROUND OF THE INVENTION

1. Field of the Invention

The present invention relates to examination tables and more particularly pertains to a new examination table system for facilitating movement of a patient lying on a tabletop of the table system.

2. Description of the Prior Art

The use of examination tables is known in the prior art. More specifically, examination tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,808,468; 4,773,637; 527,776; 5,590,429; 4,131,802; 5,507,050; and U.S. Pat. No. Des. 245,287.

While these devices fulfill their respective, particular objectives and requirements, the aforementioned patents do not disclose a new examination table system. The inventive device includes a table assembly for supporting the patient above a floor surface. The table assembly includes a generally planar tabletop and a plurality of leg members. A conveyor system is provided for moving the patient lying on the tabletop in a direction parallel to the tabletop. The conveyor system comprises a conveyor belt mounted about the table for movement in a direction parallel to a longitudinal axis of the tabletop. A pair of end rollers mounted to one of a pair of ends of the tabletop is provided for moving the conveyor belt about a pair of opposite ends of the tabletop. A drive assembly is provided for moving the conveyor belt about the tabletop. The drive assembly comprises a conveyor belt motor mounted to the table and a control for controlling operation of the conveyor belt motor.

In these respects, the examination table system according to the present invention substantially departs from the conventional concepts and designs of the prior art, and in so doing provides an apparatus primarily developed for the purpose of facilitating movement of a patient lying on a tabletop of the table system.

SUMMARY OF THE INVENTION

In view of the foregoing disadvantages inherent in the known types of examination tables now present in the prior art, the present invention provides a new examination table system construction wherein the same can be utilized for facilitating movement of a patient lying on a tabletop of the table system.

The general purpose of the present invention, which will be described subsequently in greater detail, is to provide a new examination table system apparatus and method which has many of the advantages of the examination tables mentioned heretofore and many novel features that result in a new examination table system which is not anticipated, rendered obvious, suggested, or even implied by any of the prior art examination tables, either alone or in any combination thereof.

To attain this, the present invention generally comprises a table assembly for supporting the patient above a floor surface. The table assembly includes a generally planar tabletop and a plurality of leg members. A conveyor system is provided for moving the patient lying on the tabletop in a direction parallel to the tabletop. The conveyor system comprises a conveyor belt mounted about the table for movement in a direction parallel to a longitudinal axis of the tabletop. A pair of end rollers mounted to one of a pair of ends of the tabletop is provided for moving the conveyor belt about a pair of opposite ends of the tabletop. A drive assembly is provided for moving the conveyor belt about the tabletop. The drive assembly comprises a conveyor belt motor mounted to the table and a control for controlling operation of the conveyor belt motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new examination table system apparatus and method which has many of the advantages of the examination tables mentioned heretofore and many novel features that result in a new examination table system which is not anticipated, rendered obvious, suggested, or even implied by any of the prior art examination tables, either alone or in any combination thereof.

It is another object of the present invention to provide a new examination table system which may be easily and efficiently manufactured and marketed.

It is a further object of the present invention to provide a new examination table system which is of a durable and reliable construction.

An even further object of the present invention is to provide a new examination table system which is susceptible of a low cost of manufacture with regard to both materials and labor, and which accordingly is then susceptible of low prices of sale to the consuming public, thereby making such examination table system economically available to the buying public.

Still yet another object of the present invention is to provide a new examination table system which provides in the apparatuses and methods of the prior art some of the advantages thereof, while simultaneously overcoming some of the disadvantages normally associated therewith.

Still another object of the present invention is to provide a new examination table system for facilitating movement of a patient lying on a tabletop of the table system.

Yet another object of the present invention is to provide a new examination table system which includes a table assembly for supporting the patient above a floor surface. The table assembly includes a generally planar tabletop and a plurality of leg members. A conveyor system is provided for moving the patient lying on the tabletop in a direction parallel to the tabletop. The conveyor system comprises a conveyor belt mounted about the table for movement in a direction parallel to a longitudinal axis of the tabletop. A pair of end rollers mounted to one of a pair of ends of the tabletop is provided for moving the conveyor belt about a pair of opposite ends of the tabletop. A drive assembly is provided for moving the conveyor belt about the tabletop. The drive assembly comprises a conveyor belt motor mounted to the table and a control for controlling operation of the conveyor belt motor.

Still yet another object of the present invention is to provide a new examination table system that reduces the amount of time required in moving patients about an examination table. It also reduces the frustration that patients with disabilities may experience when trying to maneuver themselves on an examination table.

Even still another object of the present invention is to provide a new examination table system that reduces the likelihood of healthcare providers injuring themselves or a patient while trying to maneuver the patient on the table.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
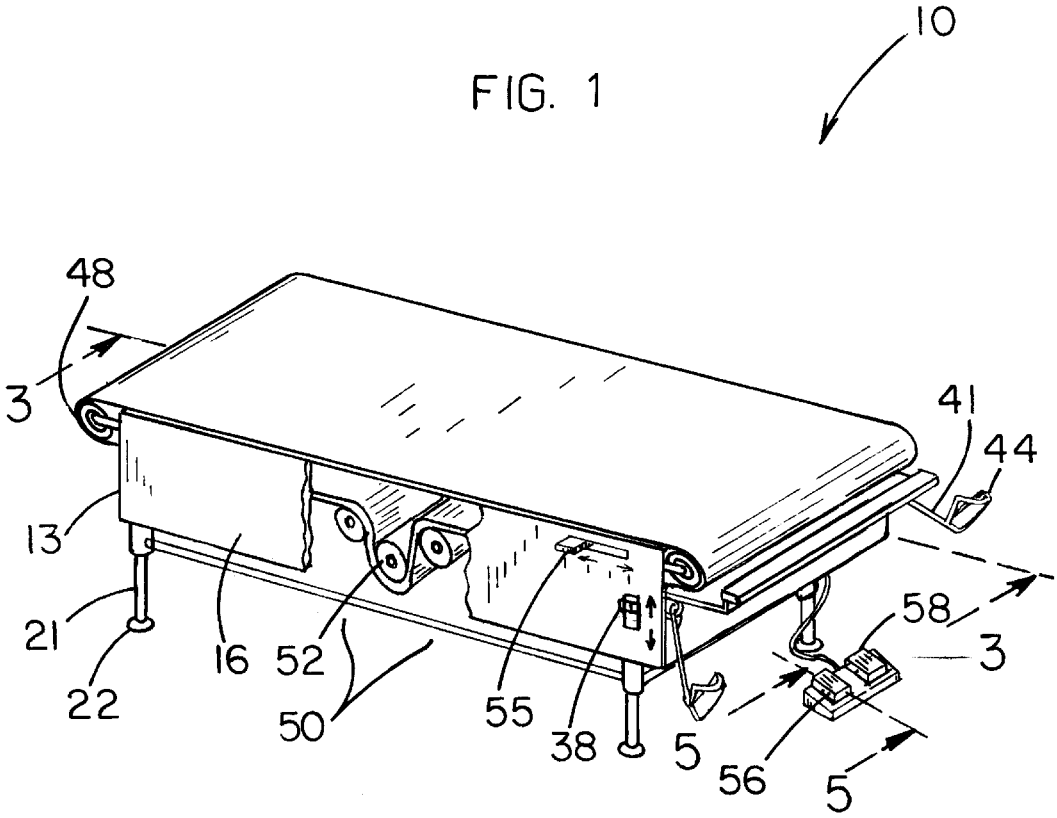
FIG. 1 is a schematic perspective view of a new examination table system according to the present invention showing a partial cut-away of the table.

With reference now to the drawings, and in particular to FIGS. 1 through 6 thereof, a new examination table system embodying the principles and concepts of the present invention and generally designated by the reference numeral 10 will be described.

As best illustrated in FIGS. 1 through 6, the examination table system 10 generally comprises a table assembly 12 for supporting the patient above a floor surface and a conveyor system 46 for facilitating movement of the patient lying on the table assembly 12.

The table assembly 12 preferably comprises a table 13 having a generally planar tabletop 14 and a bottom wall 15. A pair of side walls 16 and a pair of end walls 17 extend between the tabletop 14 and the bottom wall 15 such that an interior 18 of the table 13 is defined. The table 13 may comprise a substantially rigid material such as, for example, a wood, a plastic or a metal material.

Figure 2:
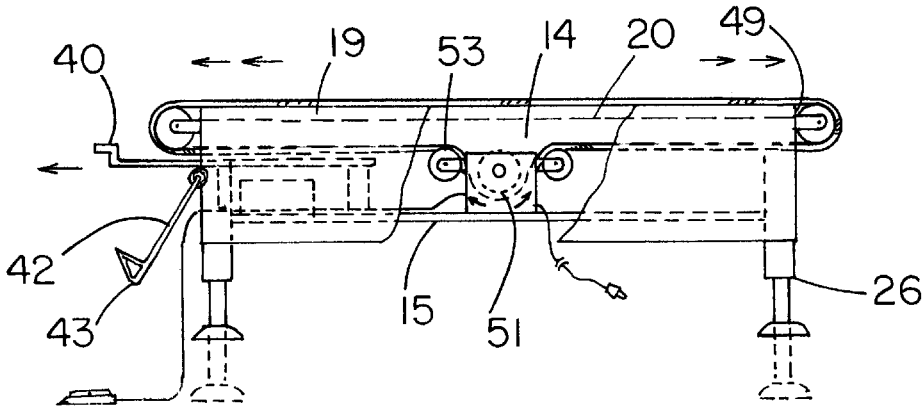
FIG. 2 is a schematic frontal view of the present invention showing the interior of the table.

As illustrated in FIG. 2, a cushion member 19 may be mounted to an upper surface 20 of the tabletop 14. The cushion member 19 may comprise a resiliently compressible material such as, for example, a foam or a rubber material.

A plurality of leg members 21 may be provided for support the table 13. Each of the leg members 21 preferably includes a pair of opposite ends 22. An end of each of the leg members 21 is mounted to a corner of the bottom wall 15. As particularly illustrated in FIG. 4, each of the leg members 21 preferably includes a first portion 23 and a second portion 24. The first portion 23 telescopes with respect to the second portion 24 for moving the table 13 between an uppermost position and a lowermost position. In one embodiment of the present invention, the uppermost position is characterized by the tabletop 14 being positioned relatively farther away from the floor surface. The lowermost position is characterized by the tabletop 14 being positioned relatively closer to the floor surface.

In one embodiment of the present invention, the first portion 23 has a first end 25 and a second end 26. The first end 25 of the first portion 23 is mounted to the bottom wall 15 of the table 13. The second end 26 of the first portion 23 includes a hole 27 extending into a cavity 28 of the first portion 23. The second portion 24 has a first end 29 and a second end 30. The first end 29 of the second portion 24 is movably extended into the cavity 28 of the first portion 23.

Figure 6:
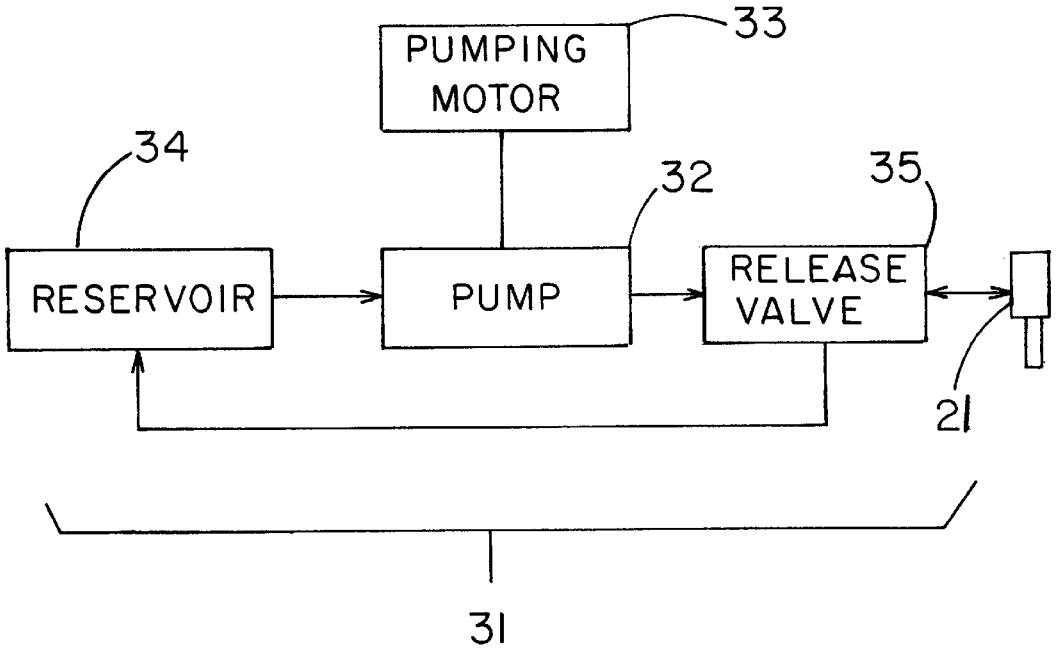
FIG. 6 is a schematic diagram view of the present invention.

As illustrated in FIG. 6, lifting means 31 is provided for moving the each of the leg members 21 between the uppermost position and the lowermost position. The lifting means 31 raises and lowers a vertical height of the tabletop 14. The lifting means 31 preferably comprises a pump 32 for pumping a fluid such as a hydraulic fluid into the cavity 28 of each of the leg members 21. The pump 32 is preferably mounted in the interior 18 of the table 13.

A pump motor 33 is provided for selectively operating the pump 32. The pump motor 33 is operationally coupled to the pump 32.

A reservoir 34 is provided for selectively holding the fluid that is pumped into each of the leg members 21. The reservoir 34 is fluidly coupled to the pump 32 such that the pump motor 33 causes the pump to withdraw the fluid from the reservoir 34.

A release valve 35 is providing for controlling the direction of the fluid. The release valve 35 is fluidly coupled to the pump 32 as well as being fluidly coupled to a port 36 that extends into each of the leg members 21.

In one embodiment of the present invention, when the pump motor 33 is running the pump 32, the fluid flows from the reservoir 34, through the pump 32 and through release valve 35 and into the cavity 28 of each of the leg members 21, wherein the tabletop 14 is raised vertically away from the floor surface. When the release valve 35 is activated the fluid is permitted to flow from the cavity 28 of each of the leg members 21 through the release valve 35 and into the reservoir 34, wherein the tabletop 14 is lowered vertically toward the floor surface.

As illustrated in FIG. 1, a switch 38 may be provided for selectively providing power to the pump motor 33. The switch 38 is preferably mounted on one of the side walls 16 of the table 13. The switch 38 would control the raising or lower of the tabletop 14. The switch 38 is electrically connected to the pump motor 33.

As illustrated in FIGS. 1 and 2, a table extension member 40 is slidably extendible from one of the end walls 17 of the table 13 and into the interior 18 of the table 13. The table extension member 40 may comprise a substantially rigid material, such as, for example, a wood, a plastic or a metal material.

As illustrated in FIG. 1, a pair of stirrups 41 may be pivotally coupled to one of the end walls 17 of the table 13. The table extension member 40 is preferably positioned generally between the pair of stirrups 41. Each of the stirrups 41 preferably comprises an elongated member 42 that includes a pair of opposite ends 43. An end of each of the elongated members 42 includes an arcuate portion 44 formed thereon. The arcuate portion 44 is preferably orientated generally perpendicular to the elongated member 41.

Figure 3:
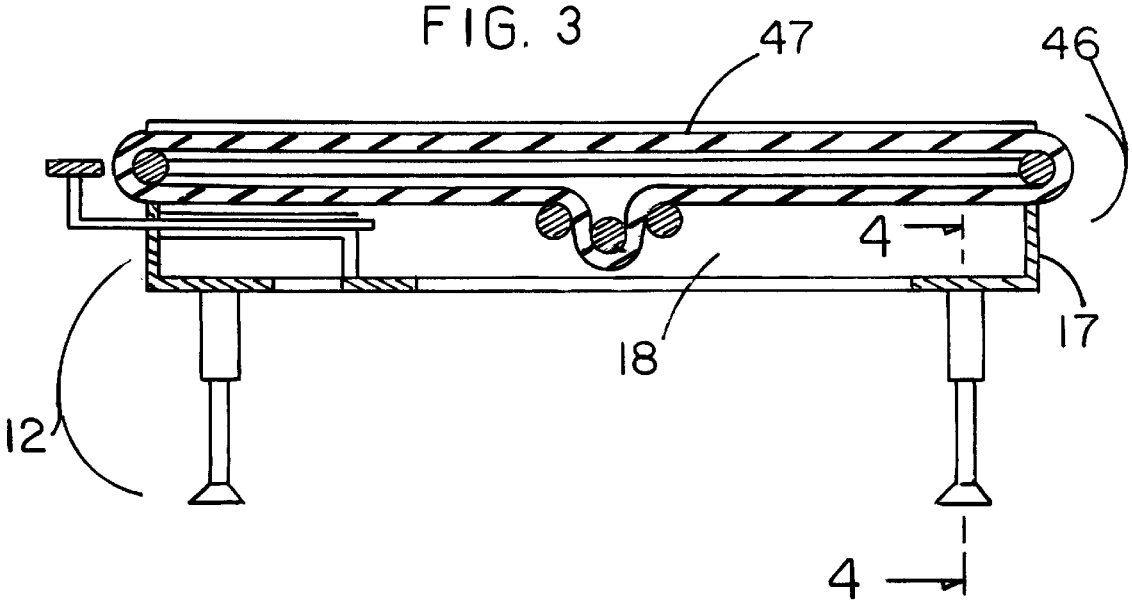
FIG. 3 is a schematic cross-sectional view of the present invention taken along line 3—3 of FIG. 2.
Figure 4:
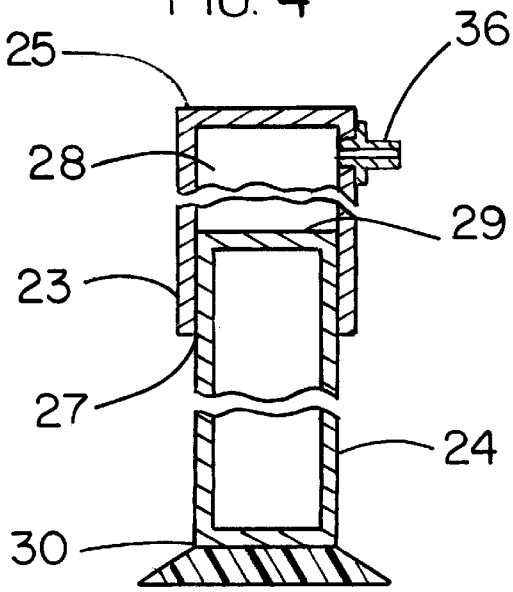
FIG. 4 is a schematic cross-sectional view of the present invention taken along line 4—4 of FIG. 3 showing a leg member.
Figure 5:
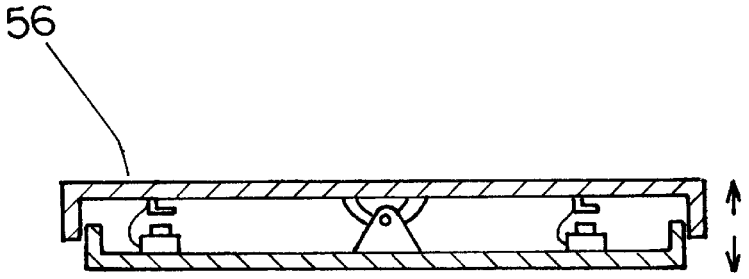
FIG. 5 is a schematic cross-sectional view of the present invention taken along line 5—5 of FIG. 1 showing a foot pedal

As illustrated in FIGS. 1, 2 and 3, a conveyor system 46 is provided for moving a patient lying on the tabletop 14 in a direction parallel to the tabletop 14. The conveyor system preferably comprises a conveyor belt 47 that is mounted about a longitudinal axis of the tabletop 14 such that a portion of the conveyor belt 47 is positioned in the interior 18 of the table 13. The conveyor belt 47 may comprise a generally flexible material such as, for example, a fabric or a plastic material.

A pair of end rollers 48 may be provided for moving the conveyor belt 47 about a pair of opposite ends 49 of the tabletop 14. Each of the end rollers 48 is preferably mounted to one of the ends 49 of the tabletop 14. A portion of the conveyor belt 47 extends about each of the end rollers 48.

A drive assembly 50 may be provided for moving the conveyor belt 47 about the tabletop 14. The drive assembly 50 preferably comprises a conveyor belt motor 51 for moving the conveyor belt 47 about the tabletop 14 in a forward or rearward direction. The conveyor belt motor 51 is preferably mounted in the interior 18 of the table 13.

A primary roller 52 is provided for moving the conveyor belt 47. The primary roller 52 is operationally coupled to the conveyor belt motor 51 for engaging the conveyor belt 47. The primary roller 52 preferably has a elongated cylindrical shape, although other shapes may be employed. A pair of secondary rollers 53 may be provided for moving the conveyor belt 47 around the primary roller 52. Each of the secondary rollers 53 are preferably mounted to the conveyor belt motor 51 and preferably positioned generally adjacent to the primary roller 52. A portion of the conveyor belt 47 extends over each of the secondary rollers 53 and under the primary roller 52.

As illustrated in FIG. 1, a control 55 may be provided for controlling operation of the conveyor belt motor 51. The control 55 operates the conveyor belt motor 51 to move the conveyor belt 47 in either the forward or the rearward direction. The control 55 is preferably mounted on one of the side walls 16 of the table 13 and is electrically connected to the conveyor belt motor 51.

As illustrated in FIG. 1, a first foot pedal 56 may be provided for controlling the conveyor belt motor 51. The first foot pedal 56 selectively provides power to the conveyor belt motor 51. In one embodiment of the present invention, the first foot pedal 56 controls the conveyor belt motor 52 in the forward and rearward directions.

A second foot pedal 58 may be provided for controlling the lifting motor 33 and the release valve 35. The second foot pedal 58 selectively provides power to the lifting motor 33 for lifting the table 13 and selectively provides power to the release valve 35 for lower the table 13. Each of the foot pedals 57 and 58 are preferably dual functioning foot pedals having a pair of electrical contacts effectuating different results.

In use, a user may facilitate vertical movement of a patient lying on the table 13 by raising or lowering the table 13 by operating the lifting motor 33. The user may also facilitate horizontal movement of a patient lying on the table 13 by operating the conveyor belt motor 51 to move the conveyor belt 43 in the forward or rearward direction.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An examination table system for facilitating movement of a patient lying on said table system, said system comprising:

a table assembly for supporting the patient above a floor surface, said table assembly including a table having a generally planar tabletop;

a conveyor system for moving a patient lying on said tabletop in a direction parallel to said tabletop, said conveyor system comprising:

a conveyor belt being mounted about said tabletop for movement in a direction parallel to a longitudinal axis of said tabletop, said conveyor belt comprising an endless belt member such that said conveyor belt is permitted to continuously move about said tabletop without end stop limitations;

a pair of end rollers for moving said conveyor belt about a pair of opposite ends of said tabletop, each of said end rollers being mounted to one of a pair of ends of said tabletop;

a drive assembly for moving said conveyor belt about said tabletop, said drive assembly including a conveyor belt motor mounted to said table; and a control for controlling operation of said conveyor belt motor;

a plurality of leg members for adjustably supporting said table above a support surface, each of said leg members comprising a telescoping hydraulic cylinder assembly such that a length of each of said leg members is fluidly adjustable;

a moving means for telescopically actuating each of said cylinder assemblies to facilitate adjusting a length of each of said leg members; and wherein said moving means includes a hydraulic pump for pumping a fluid into said hydraulic cylinder assembly of each of said leg members, a pump motor for powering said pump, a reservoir for selectively holding the fluid being pumped into each of said leg members, a release valve for permitting the fluid to flow from said cavity of each of said leg members to said reservoir, and an actuator assembly for controlling said pump.

2. The examination table system of claim 1, wherein said table additionally includes a bottom wall, a pair of side walls and a pair of end walls extending between said tabletop and said base wall such that an interior of said table is defined.

3. The examination table system of claim 2, wherein each of said leg members is mounted to a respective corner of said bottom wall of said table.

4. The examination table system of claim 2, wherein each of said cylinder assemblies of said leg members comprises a first portion and a second portion, said first portion telescoping with respect to said second portion for moving said table between an uppermost position and a lowermost position;

wherein said uppermost position is characterized by said first portion being fully extended outwardly from said second portion such that said table is positioned away from the support surface, and wherein said lowermost position is characterized by said first portion being fully received by said second portion such that said table is positioned generally closer to the support surface than when in said uppermost position.

5. The examination table system of claim 4, wherein said first portion has a first end and a second end, said first end of said first portion being mounted to said bottom wall, said second end of said first portion having a hole extending into a cavity of said first portion, wherein said second portion has an end that is movably extended into said cavity of said first portion.

6. The examination table system of claim 4, wherein said pump is mounted in said interior of said table;

wherein said motor is operationally coupled to said pump;

wherein said reservoir is fluidly coupled to said pump; and wherein said release valve is fluidly coupled to said pump, said reservoir, and to a port extending into each of said leg members.

7. The examination table system of claim 6, additionally including:

said actuator assembly comprising a first foot pedal for controlling said pump motor and said release valve, said first foot pedal selectively providing power to said pump motor and said release valve allowing a user to control a height of said tabletop with a foot.

8. The examination table system of claim 2, wherein a portion of said conveyor belt is positioned in said interior of said table, said drive assembly being mounted in said interior of said table.

9. The examination table system of claim 1, additionally including:

a main power switch for selectively providing power from a power source to said pump motor and said release valve.

10. The examination table system of claim 1, additionally including:

a table extension member being slidably extendible from an end wall of said table, said table extension member comprising a plate having a retracted position located adjacent to a lower stretch of said conveyor belt and an extended position in which said plate extends outwardly from said conveyor belt.

11. The examination table system of claim 1, additionally including:

a pair of stirrups being pivotally coupled to an end wall of said table.

12. The examination table system of claim 1, additionally including:

a primary roller for moving said conveyor belt, said primary roller being operationally coupled to said conveyor belt motor.

13. The examination table system of claim 12, additionally including:

a pair of secondary rollers for moving said conveyor belt around said primary roller, each of said secondary rollers being mounted to said motor, a portion of said conveyor belt extending over each of said secondary rollers and under said primary roller.

14. The examination table system of claim 1, additionally including:

said control comprising a second foot pedal for controlling said conveyor belt motor, said second foot pedal selectively providing power to said conveyor belt motor allowing a user to control movement of said conveyor belt about said table with a foot.

15. The examination table system of claim 1, additionally including:

a cushion member being mounted to an upper surface of said tabletop, said cushion member comprising a resiliently compressible material.

16. An examination table system for facilitating movement of a patient lying on said table system, said system comprising:

a table assembly for supporting the patient above a floor surface, said table assembly including a table having a generally planar tabletop, said table having a bottom wall, a pair of side walls and a pair of end walls extending between said tabletop and said base wall such that an interior of said table is defined;

a plurality of leg members for adjustably supporting said table above a support surface, each of said leg members comprising a telescoping hydraulic cylinder assembly such that a length of each of said leg members is fluidly adjustable, each of said leg members being mounted to a respective corner of said bottom wall of said table, each of said cylinder assemblies of said leg members comprising a first portion and a second portion, said first portion telescoping with respect to said second portion for moving said table between an uppermost position and a lowermost position, said first portion having a first end and a second end, said first end of said first portion being mounted to said bottom wall of said table, said second end of said first portion having a hole extending into a cavity of said first portion, wherein said second portion has an end that is movably extended into said cavity of said first portion;

wherein said uppermost position is characterized by said first portion being fully extended outwardly from said second portion such that said tabletop is positioned away from the support surface, and said lowermost position is characterized by said first portion being fully received by said second portion such that said tabletop is positioned generally closer to the support surface than when in said uppermost position;

a moving means for telescopically actuating each of said cylinder assemblies to facilitate adjusting a length of each of said leg members, said moving means including:

a hydraulic pump for pumping a fluid into said hydraulic cylinder assembly of each of said leg members;

a pump motor for powering said pump being mounted in said interior of said table, said motor being operationally coupled to said pump;

a reservoir for selectively holding the fluid being pumped into each of said leg members, said reservoir being fluidly coupled to said pump;

a release valve for permitting the fluid to flow from said cavity of each of said leg members to said reservoir thereby decreasing the length of said leg members and lowering said table, said release valve being fluidly coupled to said pump, said reservoir, and to a port extending into said cavity of each of said leg members;

a main power switch for selectively providing power from a power source to said pump motor and said release valve; and said actuator assembly comprising a first foot pedal for controlling said pump motor and said release valve, said first foot pedal selectively providing power to said pump motor and said release valve allowing a user to control a height of said tabletop with a foot;

a conveyor system for moving a patient lying on said tabletop in a direction parallel to said tabletop, said conveyor system comprising:

a conveyor belt being mounted about said table for movement in a direction parallel to a longitudinal axis of said tabletop, said conveyor belt comprising an endless belt member such that said conveyor belt is permitted to continuously move about said tabletop without end stop limitations, wherein a portion of said conveyor belt is positioned in said interior of said table;

a pair of end rollers for moving said conveyor belt about a pair of opposite ends of said tabletop, each of said end rollers being mounted to one of a pair of ends of said tabletop;

a drive assembly for moving said conveyor belt about said tabletop being mounted in said interior of said table, said drive assembly including a conveyor belt motor mounted to said table;

a primary roller for moving said conveyor belt, said primary roller being operationally coupled to said conveyor belt motor;

a pair of secondary rollers for moving said conveyor belt around said primary roller, each of said secondary rollers being mounted to said motor, a portion of said conveyor belt extending over each of said secondary rollers and under said primary roller; and a control for controlling operation of said conveyor belt motor, said control comprising a second foot pedal for controlling said conveyor belt motor, said foot pedal selectively providing power to said conveyor belt motor allowing a user to control movement of said conveyor belt about said tabletop with a foot;

a table extension member being slidably extendible from one of said end walls of said table;

a pair of stirrups being pivotally coupled to one of said end walls of said table; and a cushion member being mounted to an upper surface of said tabletop, said cushion member comprising a resiliently compressible material.

* * * * *